US006020053A

United States Patent [19]

Suda

[11] Patent Number: 6,020,053

[45] Date of Patent: Feb. 1, 2000

[54] PRINTING SHEET FOR INK STAMP

[75] Inventor: Mitsunobu Suda, Ichinomiya, Japan

[73] Assignee: Brother Kogyo Kabsushiki Kaisha, Aichi-ken, Japan

[21] Appl. No.: 08/866,803

[22] Filed: May 30, 1997

[30] Foreign Application Priority Data

May 31, 1996 [JP] Japan ..... 8-160678

[51] Int. Cl.[7] ..... B41K 1/50; B41N 1/12

[52] U.S. Cl. ..... 428/305.5; 101/333; 101/401.1; 427/595; 427/597; 427/282; 428/317.9; 428/321.3

[58] Field of Search ..... 101/103, 333, 101/401.1; 427/595, 597, 282; 428/141, 159, 305.5, 306.6, 321.3, 317.9

[56] References Cited

U.S. PATENT DOCUMENTS 4,212,839 7/1980 Funahashi ..... 264/45.3

5,611,279 3/1997 Ando et al. ..... 101/401.1

FOREIGN PATENT DOCUMENTS 50-31908 3/1975 Japan .

*Primary Examiner*—Blaine Copenheaver

*Attorney, Agent, or Firm*—Kane, Dalsimer, Sullivan and Levy, LLP

[57] ABSTRACT

A printing sheet is made from a porous resin sheet containing a predetermined amount of carbon grains. In order to manufacture the printing sheet, a mask (which partially shields the infrared rays according to a predetermined pattern) is placed on a transparent plate and the printing sheet is placed on the mask sheet. Flash bulbs irradiate the infrared rays onto the mask sheet. Infrared rays irradiated onto the transparent portion of the mask sheet pass through the mask sheet and reach the printing sheet, causing the carbon grains to heat the resin sheet such that pores in said resin sheet are sealed to form a non-print portion on said porous resin sheet corresponding to said transparent portion.

13 Claims, 8 Drawing Sheets

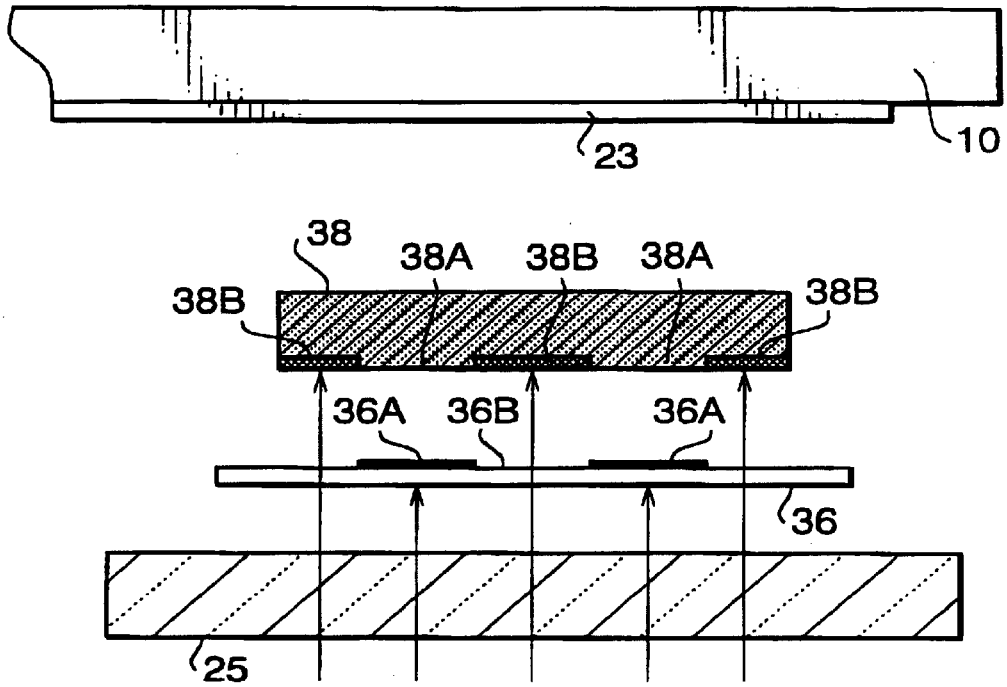
FIG. 7
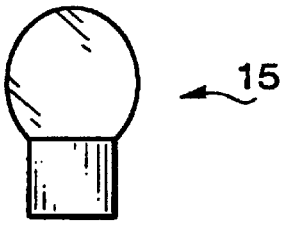
FIG. 8A
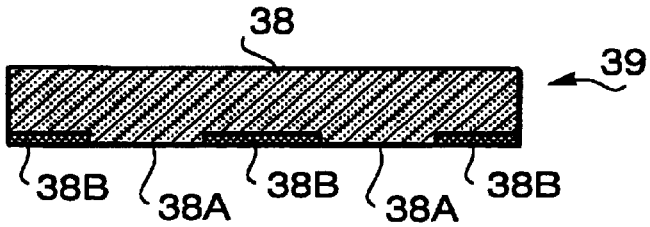
FIG. 8B
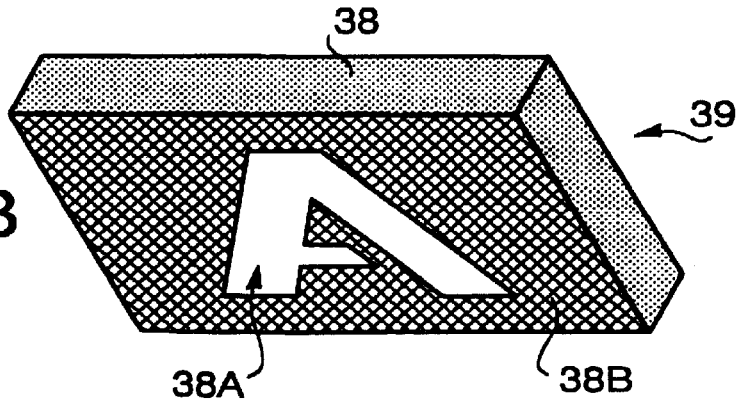

PRINTING SHEET FOR INK STAMP

BACKGROUND OF THE INVENTION

The present invention relates to an ink stamp having a printing sheet.

There is a type of ink stamp including a printing sheet that is impregnated with ink such that the ink stamp may be used a relatively large number of times without replenishing the ink. FIGS. 1A and 1B are a sectional view and a perspective view of the printing sheet. The printing sheet 139 is made of a porous resin sheet 138 on which a print portion 138A and a non-print portion 138B are formed. The print portion 138A allows the permeation of the impregnated ink whereas the non-print portion 138B blocks the permeation of the impregnated ink.

FIG. 2 shows the process for manufacturing the printing sheet 139. A mask sheet 136 is placed on a transparent base plate 125, which includes a pattern portion 136A which blocks the electromagnetic waves and a non-pattern portion 136B which allows the electromagnetic waves to pass. A black film 137 is placed on a mask sheet 136 and the porous resin sheet 138 is placed above the black film 137. Then, a flash bulb 115 is flashed and infrared light rays (shown by arrows) are irradiated onto the lower surface of the mask sheet 136. Infrared rays irradiated onto the pattern portion 136A on the mask sheet 136 are blocked by the pattern portion 136A, whereas infrared rays irradiated onto non-pattern portion 136B pass through the mask sheet 136. The infrared rays passing through the mask sheet 136 reach the black film 137 causing the black film 137 to generate heat. The heated surface of the porous resin sheet 138 is caused to melt such that pores near the surface thereof are sealed. Conversely, since the infrared rays are blocked by the pattern portion 136A of the mask sheet 136, the portion of the black film 137 which corresponds to the pattern portion 136A does not generate heat, so that the pores near the surface of the porous resin sheet 138 corresponding thereto are not sealed. Thus, the print portion 138A and the non-print portion 138B are formed on the porous resin sheet 138 producing the printing sheet 139.

However, in the conventional manufacturing process, the black film 137 must be interposed between the mask sheet 136 and the porous resin sheet 138 to act as a heating element. As such, the manufacturing process requires the positioning of the black film 137 between the porous resin sheet 138 and the mask sheet 136. Thus, the use of the black film 137 increases the manufacturing cost of the printing sheet 139.

SUMMARY OF THE INVENTION

It is therefore an object of the present invention to simplify the manufacturing process of a printing sheet and to reduce the manufacturing cost of the printing sheet.

According to one aspect of the present invention, there is provided a printing sheet including a porous resin sheet which can be impregnated with ink and a heat-generating material which generates heat when exposed to electromagnetic waves (such as infrared rays). A pattern is formed on a surface of the porous resin sheet, which includes a print portion which allows the permeation of the impregnated ink and a non-print portion which blocks the permeation of the impregnated ink. The pattern is formed by exposing the porous resin sheet to the electromagnetic waves via a mask (including a pattern portion which blocks the electromagnetic waves and a non-pattern portion which allows the electromagnetic waves to pass).

As constructed above, the printing sheet can be manufactured by exposing a surface of the porous resin sheet via the mask. Thus, there is no need to provide a separate black film to generate heat and thus, there is no need to perform the extra step of placing the black film between the mask and the porous resin sheet. Therefore, the manufacturing process of the printing sheet can be simplified.

It is preferable that the heat generating material includes grains contained in the porous resin sheet. Thus, the porous resin sheet can be easily formed by mixing the grains (such as carbon grains) with a resin material such as polyolefin foam or the like.

Alternatively, the heat generating material may includes a heat generating layer formed on the porous resin sheet. The heat generating layer is porous such that the heat generating layer allows the permeation of ink. Since the heat generating layer exists on the porous resin sheet, the printing sheet can be manufactured by exposing a surface of the porous resin sheet via the mask.

In a particular arrangement, the content of the carbon grains in the porous resin sheet is from 0.01 to 15 wt %. With such an arrangement, the porous resin sheet is gray and, when heated, turns black. Accordingly, it can be confirmed which of various colors of ink has been impregnated in the porous resin sheet. Further, since the carbon is greater than or equal to 0.01 wt %, the porous resin sheet is easily heated (such that the pores at the surface thereof are sealed) by a standard flash bulb having a standard flashing intensity. Thus, a strong flash bulb is not needed.

According to another aspect of the present invention, there is provided a blank sheet used to produce a printing sheet. The blank sheet includes a porous resin sheet which can be impregnated with ink, and a heat generating material provided to the porous resin sheet which generates heat when exposed to electromagnetic waves.

With such a blank sheet, because of the existence of the heat generating material, the printing sheet can be manufactured by exposing a surface of the porous resin sheet via the mask. Thus, there is no need to provide a separate black film to generate heat and thus, there is no need to perform the extra step of placing the black film between the mask and the porous resin sheet. Therefore, the manufacturing process of the printing sheet can be simplified.

According to still another aspect of the present invention, there is provided a method for producing a printing sheet including (1) placing the porous resin sheet on the mask and (2) exposing a surface of the porous resin sheet to the electromagnetic waves via the mask. The exposed portions of the porous resin sheet are heated so that the exposed portions melt such that pores on the porous resin sheet are sealed.

Since the printing sheet is manufactured by placing the porous resin sheet and the mask and exposing the porous resin sheet, the printing sheet can be manufactured in a simple manner.

According to yet another aspect of the present invention, there is provided a printing sheet manufacturing device that includes a base, a transparent cover plate provided to the base, an electromagnetic wave source provided in the base, and at least three lids pivotably provided to the base. The lids including first, second and third lids. When the three lids are closed, the first lid covers the material placed on the cover plate, the second lid covers the first lid, and the third lid covers the second lid.

As constructed above, when a mask (including a pattern portion which blocks the electromagnetic waves and a non-pattern portion which allows the electromagnetic waves to pass) is placed on the cover plate and a porous resin sheet is placed on the mask, the porous resin sheet can be exposed to the electromagnetic waves via the mask. Thus, the printing sheet can be manufactured. Further, because of the three pivotable lids, it is possible to use "a principle of the lever" to uniformly press to the material. The force to be applied for pressing the material is relatively low, compared with the case where the manufacturing device has two lids.

In a particular arrangement, a first lid of the at least three lids is provided with an elastic sheet for pressing a material placed on the cover plate. With such an arrangement, when a porous resin sheet and a mask is placed on the cover plate, the porous resin sheet and the mask are closely contact with each other. Thus, the pattern of the mask can be accurately converted on the porous resin sheet. Preferably, the second lid is provided with a press portions for pressing the first lid to the material. Further the third lid is provided with a press portions for pressing the second lid to the first sheet. As constructed above, each subsequent lid contacts each prior lid and provides even pressure on an upper surface of the prior lid. Thus, the porous resin sheet and the mask can be further closely contact each other.

Optionally, the base further includes a locking portion and the third lid is provided with a locking catch. When the third lid is closed, the locking catch engages with the locking portion to lock the final lid to the base. In this way, the third lid can be locked to the base to prevent the lid from being accidentally opened during operation. Further optionally, the base further includes a switch for activating the electromagnetic wave source. The switch is activated only when the locking catch engages with the locking portion. Thus, the switch is not activated when the third cover is opened and therefore it is prevented that the operator is accidentally exposed by electromagnetic wave from the source.

Preferably, the printing sheet manufacturing device is provided with a handle so that the printing sheet manufacturing device is easy to carry, for example, the handle may be provided on the final lid and the final lid may include a recessed portion for storing the handle when not in use.

BRIEF DESCRIPTION OF THE DRAWINGS

FIG. 7 is a schematic diagram illustrating a process for making the printing sheet according to an embodiment of the invention;

FIGS. 8A and 8B show a sectional view and a perspective view, respectively, of a printing sheet formed by the process of FIG. 7;

DETAILED DESCRIPTION OF THE PREFERRED EMBODIMENTS

Figure 1A:
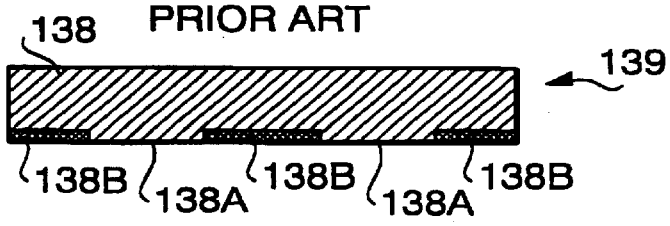
FIG. 1A PRIOR ART
FIGS. 1A and 1B show a sectional view and a perspective view, respectively, of a conventional printing sheet.
Figure 1B:
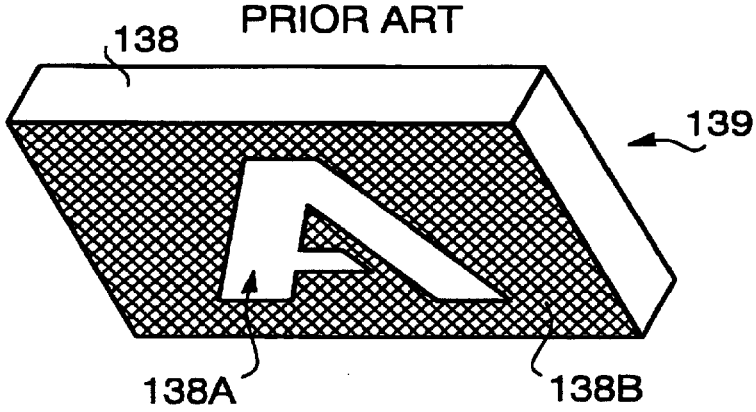
FIG. 1B PRIOR ART
Figure 2:
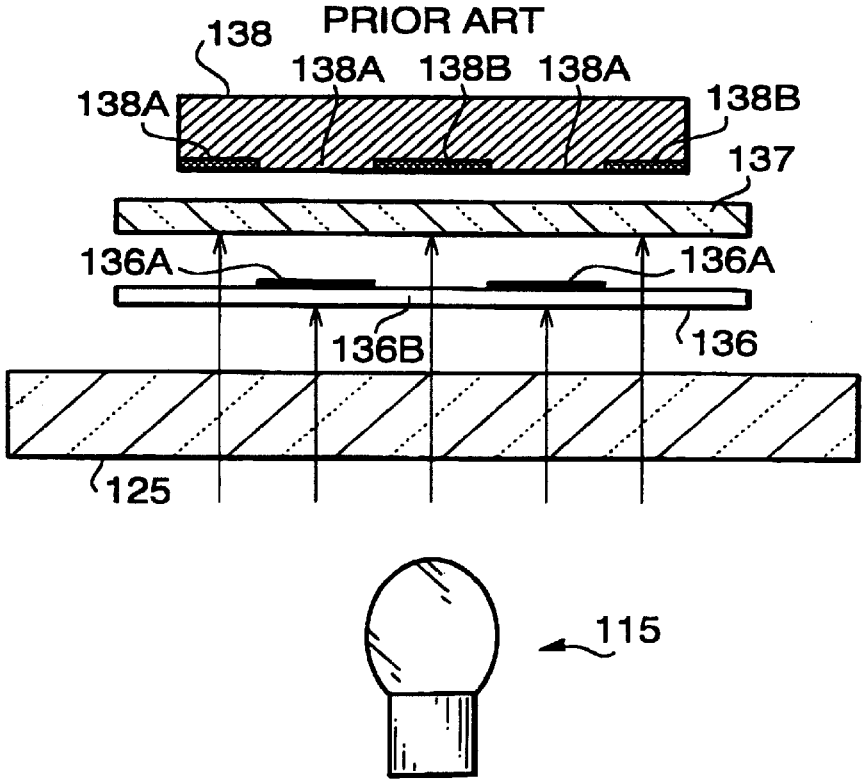
FIG. 2 PRIOR ART
FIG. 2 is a schematic diagram illustrating a conventional process for making a printing sheet of FIG. 1.

A printing sheet and a method for manufacturing a printing sheet according to a first embodiment of the present invention are described with reference to FIGS. 3 to 9B.

First, an arrangement of a printing sheet manufacturing device 2 is described with reference to FIGS. 3, 4A and 4B. The printing sheet manufacturing device 2 includes a base 4 and three movable lids 8, 9 and 10 disposed above the base 4.

The base 4 is provided with a recessed portion 26, shaped as an inverted frustum of a pyramid, at the interior thereof. The recessed portion 26 opens at the side of the movable lids 8, 9 and 10 and is covered by a transparent cover plate 25, made from acrylic. Two flash bulbs 15 are mounted to a mounting portion 27 on a bottom surface 26A of the recessed portion 26. Each of the flash bulbs 15 is connected to a limit switch 14 (via not shown wiring).

The movable lids 8, 9 and 10 are pivotally supported by the base 4 and, in a closed state, cover the cover plate 25 and the recessed portion 26.

Figure 4A:
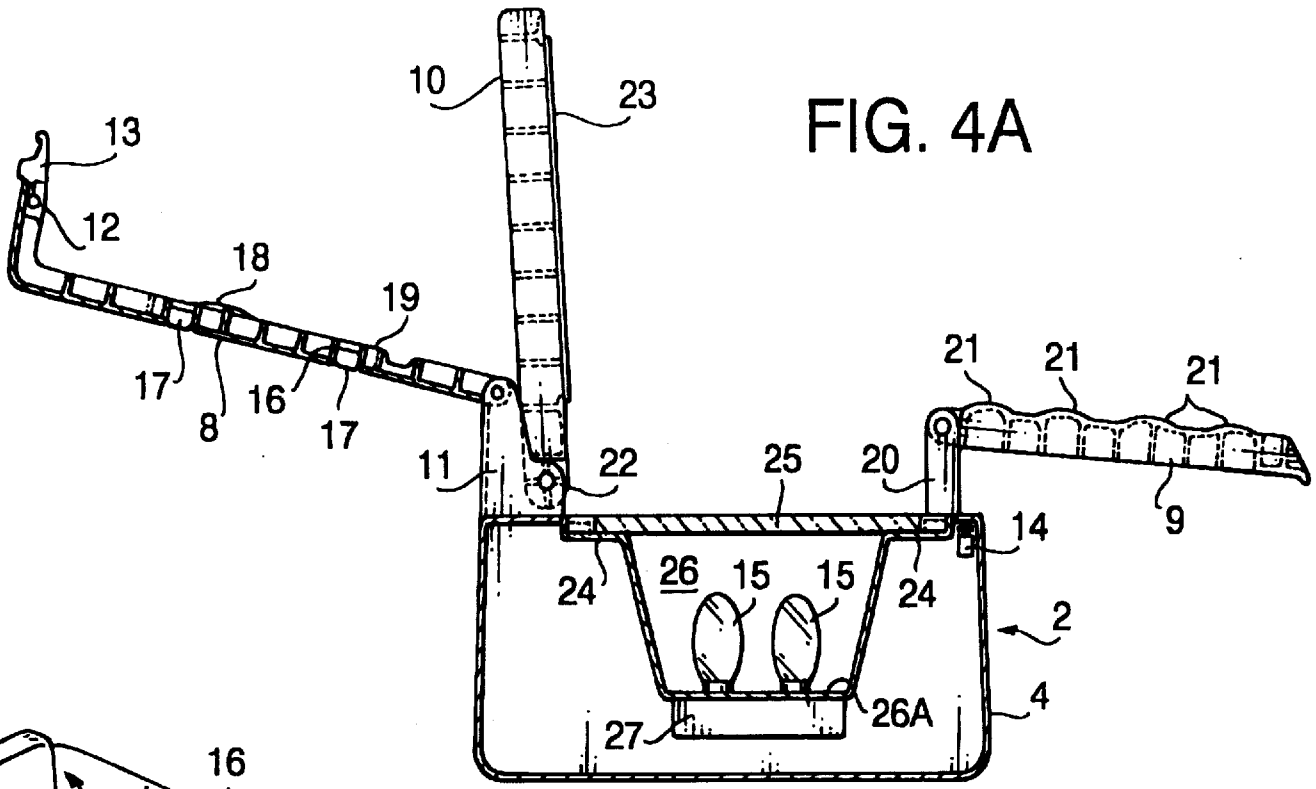
FIGS. 4A and 4B are a sectional view of the printing sheet manufacturing device in an open state and a perspective view of a third lid.

As shown in FIG. 4A, the first movable lid 10 is pivotally supported by support portions 22 formed on the base 4. A lower surface of the first movable lid 10 is provided with an elastic sheet 23, made of rubber, to apply a uniform force to a porous resin sheet 38 (as described below).

The second movable lid 9 is pivotally supported by support walls 20 formed on the base 4 on a side opposite to the support portions 22. The second movable lid 9 is arranged such that in a closed state, as shown in FIG. 3, the second movable lid 9 covers the first movable lid 10. Further, a lower surface of the second movable lid 9 is provided with four press portions 21 projecting toward the first movable lid 10. The press portions 21 apply a uniform press load to the first movable lid 10 when in the closed state shown in FIG. 3.

Figure 3:
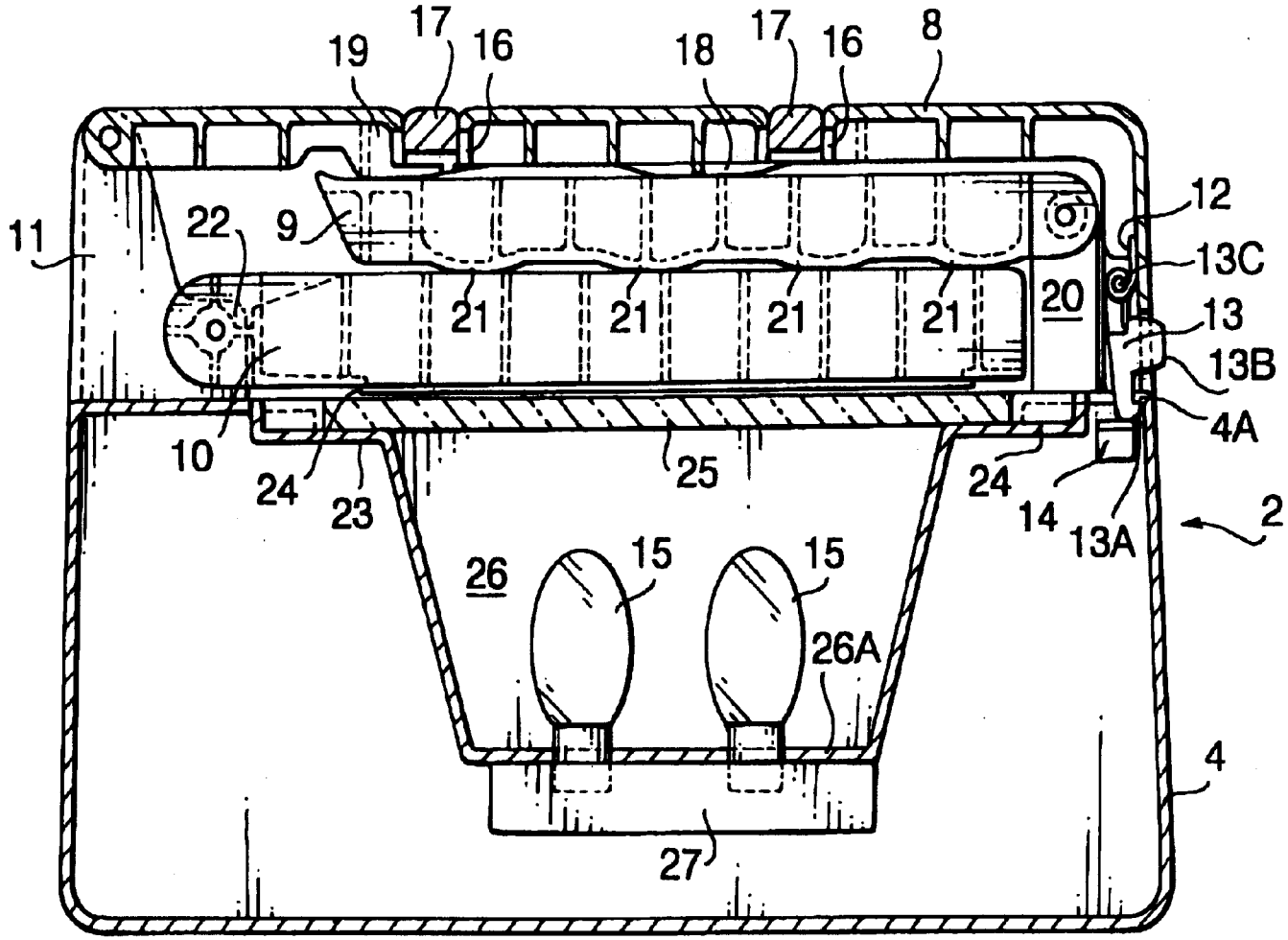
FIG. 3 is a schematic sectional view of a printing sheet manufacturing device.

The third movable lid 8 is pivotally supported by a pair of support walls 11 which project from the upper side of the base 4 such that the third movable lid 8 covers the second and first movable lids 9 and 10 in the closed state shown in FIG. 3. A lower surface (i.e., the surface confronting the second movable lid 9 in a closed state) of the third movable lid 8 is provided with press portions 18 and 19 projecting toward the second movable lid 9. The press portions 18 and 19 apply a uniform press load to the second movable lid 9 when in the closed state shown in FIG. 3. Further, the movable lid 8 is provided with a locking claw 13 which is swingable about a pin 13C and urged outward by a spring 12. As shown in FIG. 3, the locking claw 13 includes a locking portion 13A which is formed to lock with a retaining portion 4A formed on the base 4 in order to lock the movable lid 8 to the base 4. The locking claw 13 also includes a release portion 13B that extends outside of the third movable lid 8 that is pushed to release the locking portion 13A from the retaining portion 4A.

As constructed above, since the first lid 10 presses the porous resin sheet 38 (described below) on the cover plate 25, the second lid 9 presses the first lid 10, and the third lid 8 presses the second lid 9, it is possible to press the porous resin sheet 38 against the cover plate 25 with a relatively light force, using a principal of the lever.

In this embodiment, as the locking portion 13A locks to the retaining portion 4A, the locking claw 13 simultaneously activates the limit switch 14 to thereby activate the flash bulbs 15. With this arrangement, the flash bulbs 15 cannot be flashed unless the third movable lid 8 is securely closed, thus protecting a user of the printing sheet manufacturing device 2.

Figure 4B:
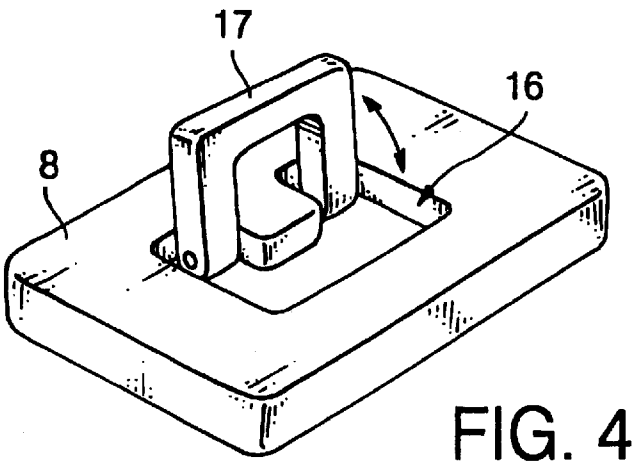

FIG. 4B is a perspective view of the third lid 8. The third movable lid 8 has a recessed portion 16 and a handle 17 is pivotably provided in the recessed portion 16 so that the handle 17 is storable in the recessed portion 16. This, the ink stamp manufacturing device 2 can be carried easily and the handle 17 can be stored when not in use.

Figure 5:
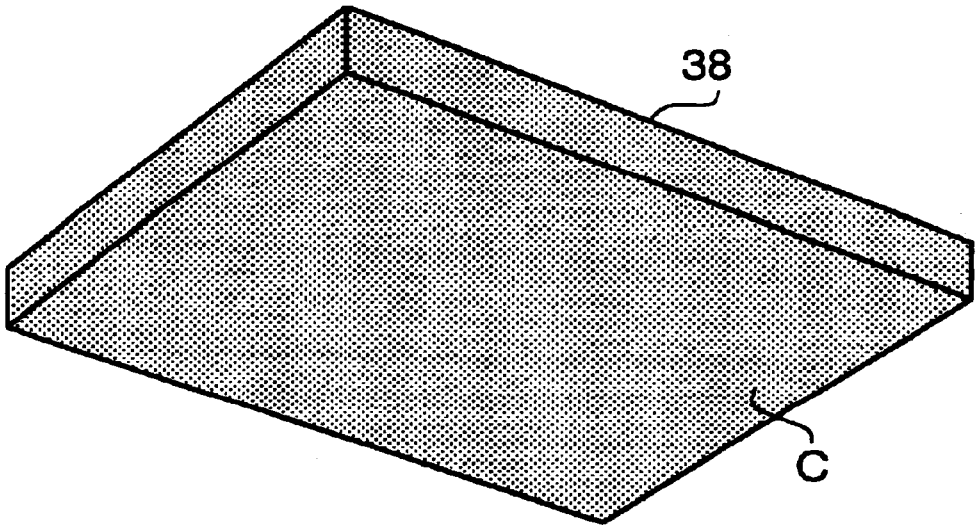
FIG. 5 is a perspective view of a blank sheet used for manufacturing the printing sheet.
Figure 6:
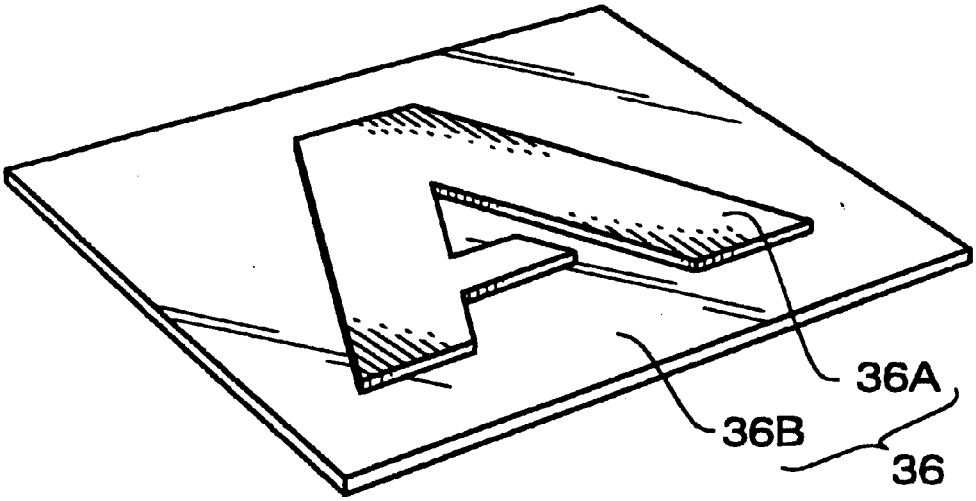
FIG. 6 is a perspective view of a mask sheet used for manufacturing the printing sheet.

FIGS. 5 and 6 are perspective views of a porous resin sheet 38 and a mask sheet 36 used in manufacturing a printing sheet (described below). The porous resin sheet 38 is a polyolefin foam having a porosity such that porous resin sheet 38 can be impregnated with ink. Further, the porous resin sheet 38 contains a predetermined amount of carbon grains (denoted by C in FIG. 5). The content of the carbon in the porous resin sheet 38 is in the range of 0.01 –15 wt % such that the color of the porous resin sheet 38 is gray. In FIG. 5, a pattern has not yet been formed on the porous resin sheet 38. The porous resin sheet 38 at this stage is referred to as a "blank sheet". The mask sheet 36 is a transparent sheet on which a pattern portion 36A (not transparent) such as a character, figure, or the like, is formed. Alternatively, the mask sheet 36 may be a manuscript (a piece of paper on which a pattern is formed) treated with an alcohol solvent or the like.

A process for manufacturing a printing sheet 39 using the printing sheet manufacturing device 2 is described with reference to FIGS. 3 to 9B. First, the printing sheet manufacturing device 2 is opened, that is, the movable lids 8, 9 and 10 are moved from the state shown in FIG. 3 to the state shown in FIG. 4. Next, as shown in FIG. 7, the mask sheet 36 is placed on the cover plate 25 and the porous resin sheet 38 is laid on the mask sheet 36. Next, the first and second movable lids 10 and 9 are closed, respectively, so that the elastic sheet 23 evenly presses the porous resin sheet 38 and the mask sheet 36 against the transparent cover plate 25. The movable lid 8 is then closed and locked to the base 4 by pressing the locking portion 13A of the locking claw 13 to the retaining portion 4A. As the movable lid 8 is locked, the locking claw 13 also activates the limit switch 14 causing the flash bulbs 15 to flash.

As shown in FIG. 7, when the flash bulbs 15 flash, infrared rays (shown by arrows) pass through the transparent cover plate 25 and are irradiated onto the lower surface of the mask sheet 36. The pattern portion 36A on the mask sheet 36 blocks some of the infrared rays and a non-pattern (transparent) portion 36B of the mask sheet 36 allows some of the infrared rays to pass through the mask sheet 36. The infrared rays passing through the non-pattern portion 36B reach the porous resin sheet 38, which heats the porous resin sheet 38 to cause pores thereof to melt and be sealed. Accordingly, a non-print portion 38B is formed on the porous resin sheet 38, such that ink will not permeate the non-print portion 38B. On the other hand, the infrared rays blocked by the pattern portion 36A do not reach the porous resin sheet 38, and a print portion 38A of the porous resin sheet 38, which corresponds to the pattern portion 36A of the mask sheet 36, is not heated. As explained above, the use of carbon as a component of the porous resin sheet 38 ensures that sufficient heat is generated to cause the non-print portion 38B of the porous resin sheet 38 to melt such that the pores are sealed.

After a predetermined operation of the flash bulbs 15, the release portion 13B is pushed to unlock the third movable lid 8, the movable lids 10, 9 and 8 are opened, and the porous resin sheet 38 is removed. The porous resin sheet 38 now includes, on a lower surface thereof, the print portion 38A which is porous and the non-print portion 38B which is non-porous and is now referred to as the printing sheet 39 which is shown in FIGS. 8A and 8B.

Figure 9A:
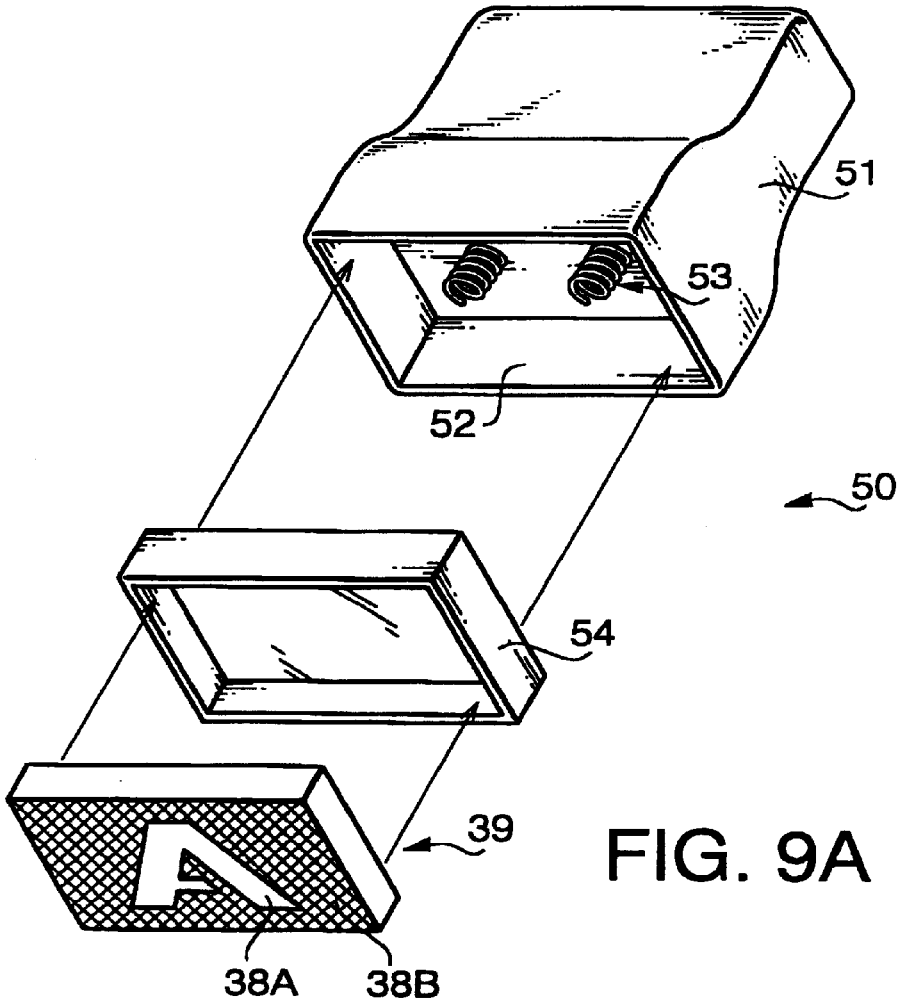
FIGS. 9A and 9B are an exploded perspective view and a perspective view of an ink stamp including the printing sheet of FIG. 8A and 8B.
Figure 9B:
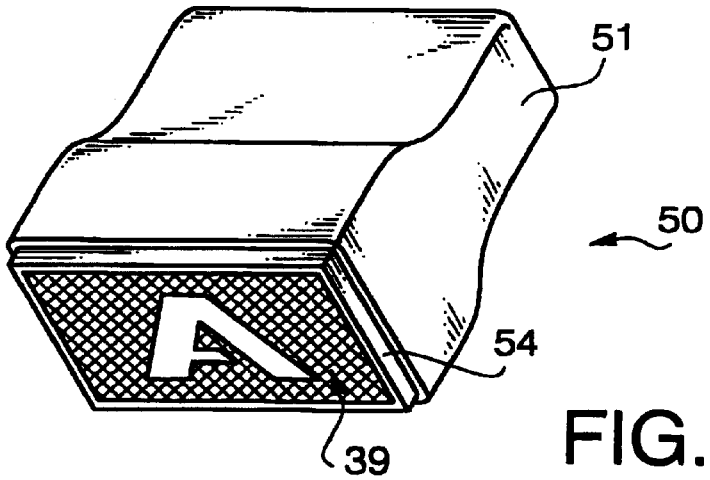

FIGS. 9A and 9B are an exploded perspective view and a perspective view of an ink stamp 50. The printing sheet 39 is impregnated with ink and mounted to a casing 54. The casing 54 covers the four side ends and back surface (opposite surface to the print portion 38A) of printing sheet 39. The stamp 50 includes a stamp body 51 having a recess 52 for receiving the casing 54 therein and springs 53 for biasing the casing 54. Thus, the user can hold the stamp body 51 and push the printing sheet 39 onto printing medium (not shown), to thereby form an image on the paper.

In the above manufacturing process, the non-print portion 38B of the porous resin sheet 38 will turn black due to the sealing of the pores at the surface, while the print portion 38A will remain gray. Accordingly, the print portion 38A may be clearly discriminated from the non-print portion 38B. Thus, it can be confirmed which of various colors of ink has been impregnated in the printing sheet 39. Further, since the content of the carbon in the porous resin sheet 38 is greater than or equals to 0.01 wt %, the porous resin sheet 38 is easily heated (to melt the porous resin sheet 38 enough to seal the pores at the surface thereof) by a flash bulb having a usual flashing intensity. Thus, a strong flash bulb is not needed.

Using the porous resin sheet 38 described above, there is no need to provide a separate black film to generate heat and thus, there is no need to perform the extra step of placing the black film between the mask sheet 36 and the porous resin sheet 38. Further, the porous resin sheet 38 can be easily formed using a conventional forming method by mixing a carbon with a resin material such as polyolefin foam or the like. Therefore, the manufacturing process of making the printing sheet 39 can be simplified and the manufacturing cost thereof can be reduced.

Figure 10A:
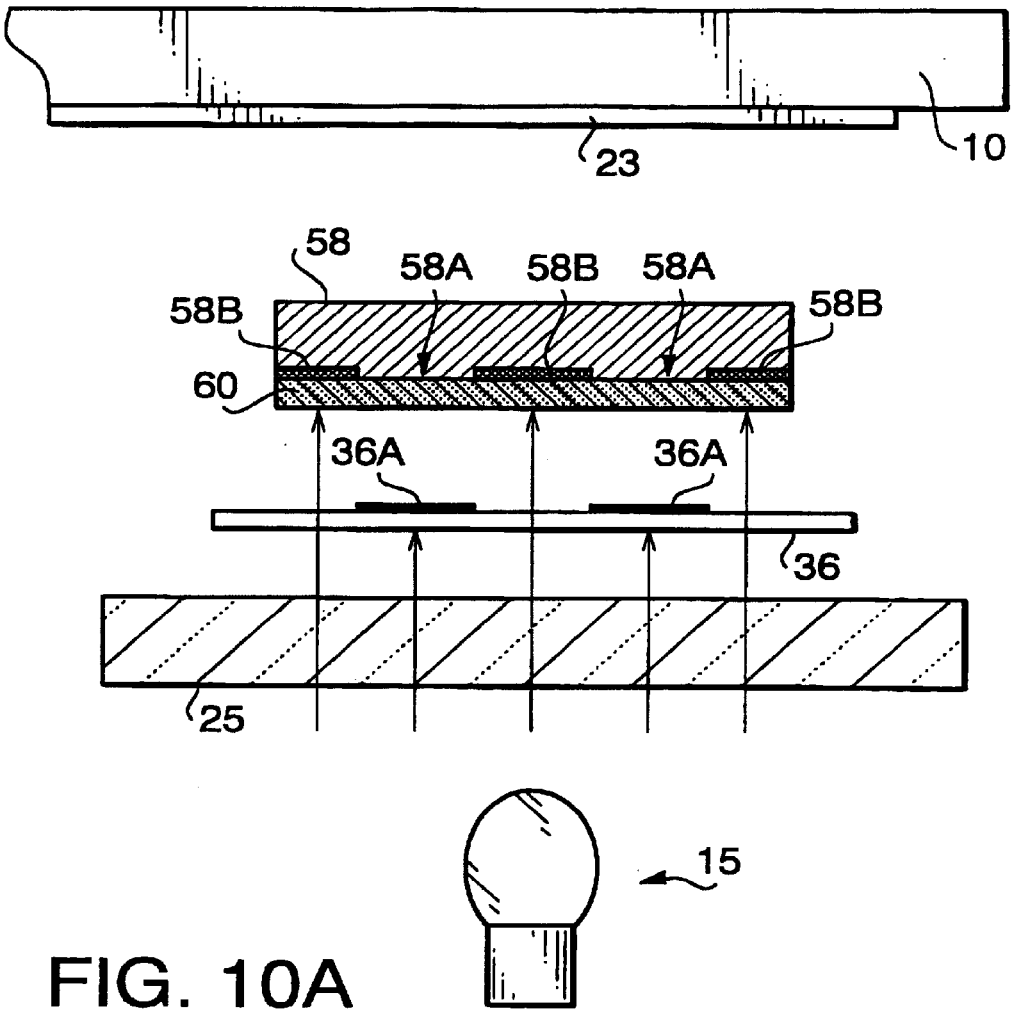
FIGS. 10A, 10B, and 10C are a schematic diagram illustrating a process for making a printing sheet according to another embodiment of the invention, a sectional view of a resin sheet used in the process of FIG. 10A, and a sectional view of an alternative arrangement of the resin sheet shown in FIG. 10B, respectively.
Figure 10B:
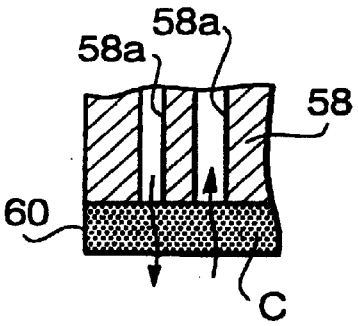

A second embodiment of the present invention is now described. In the second embodiment, instead of the porous resin sheet 38 containing carbon grains, a porous resin sheet 58 (which does not contain carbon grains) is provided with a heat generating layer 60 as shown in FIG. 10A. The porous resin sheet 58 has pores 58*a* and may be impregnated with ink. The heat generating layer 60 includes a predetermined amount of carbon grains C layered in such a manner that there are pores between respective carbon grains C as shown in FIG. 10B. Thus, the grains C do not block a permeation of ink from the pores 58*a* of the porous resin sheet 58.

The process to manufacture a printing sheet 69 using the porous resin sheet 58 is illustrated in FIG. 10A. The mask sheet 36 is placed on the transparent base plate 25 and the porous resin sheet 58 is laid on the mask sheet 36 such that the heat generating layer 60 is in contact with the mask sheet 36. Then the lids 8, 9, and 10 (FIG. 3) are closed and the flash bulbs 15 flash.

When the flash bulbs 15 flash, infrared rays (shown by arrows) passing through the transparent cover plate 25 are irradiated onto the heat generating layer 60, which heats the heat generating layer 60 to cause pores at the surface of the porous resin sheet 38 to melt and be sealed. Thus, a non-print portion 58B is formed on the porous resin sheet 58 corresponding to the non-pattern portion 36B of the mask sheet 36. On the other hand, the infrared rays blocked by the pattern portion 36A do not reach the heat generating layer 60, and a print portion 38A of the porous resin sheet 38 (which corresponds to the pattern portion 36A of the mask sheet 36) is not heated.

Figure 11A:
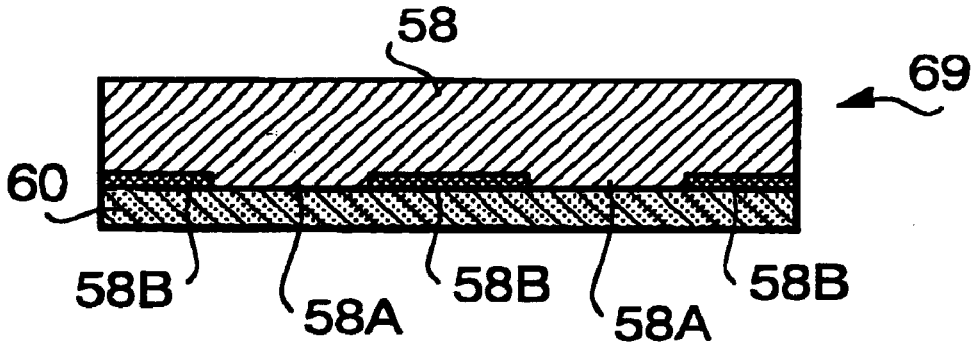
FIGS. 11A and 11B show a sectional view and a perspective view, respectively, of a printing sheet formed by the process of FIG. 10A.
Figure 11B:
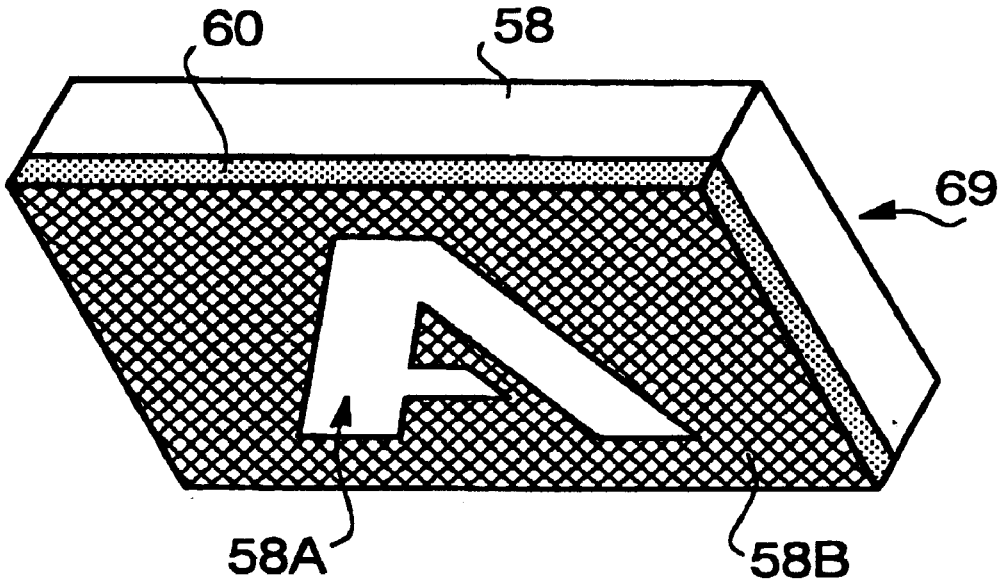

The resulting printing sheet 69, shown in FIGS. 11A and 11B includes, on a lower surface thereof, a print portion 58A and a non-print portion 58B. The printing sheet 69 is then impregnated with ink and mounted to the ink stamp in a similar manner to the first embodiment as shown in FIG. 9A, 9B and 9C.

In the printing sheet 69, since there are gaps between the carbon grains, the color of impregnated ink is distinguishable. Thus, it can be confirmed whether various colors have been impregnated or not and how the various colors have been separately applied.

Using the porous resin sheet 58 provided with the heat generating layer 60, there is no need to provide a separate black film to generate heat and thus, there is no need to perform the extra step of placing the black film between the mask sheet 36 and the heat generating layer 60 of the porous resin sheet 58. Therefore, the manufacturing process of the printing sheet 69 can be simplified and the manufacturing cost thereof can be reduced.

The heat generating layer can be made by laminating a film including carbon grains C, pores and a solvent onto the porous resin sheet 58. In this case, the content of the carbon grains C in the heat generating layer 60 is set from 2 to 20 wt %, which can be determined so that the porous resin sheet 58 is effectively heated when exposed to the infrared rays.

Figure 10C:
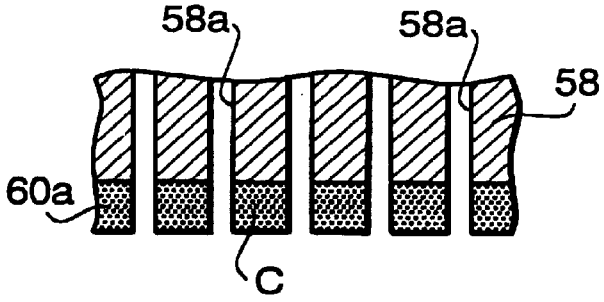

FIG. 10C shows an alternative heat generating layer 60*a* The heat generating layer 60*a* may be arranged such that the heat generating layer 60*a* does not cover the pores 58*a* in the resin sheet 58. Such heat generating layer 60*a* may be formed by lightly brushing the carbon grains C onto the resin sheet 58. Also, the heat generating layer 60*a* can be formed by applying an agent including carbon grains C and a solvent onto the porous resin sheet 58 and then dripping a solvent through the resin sheet 58 such that the solvent dissolves portions of the heat generating layer 60*a* at the exits of the pores 58*a*. With such an arrangement, ink may easily pass through the heat generating layer 60*a*.

In the above embodiments, the carbon grains C may be replaced by any material as long as the material causes the generation of heat when exposed to infrared rays.

The present disclosure relates to subject matter contained in Japanese patent Application No. HEI 08-160678, filed on May 31, 1996, which is expressly incorporated herein by reference in its entirety.

What is claimed is:

1. A printing sheet used in an ink stamp, said printing sheet comprising:

a porous resin sheet which can be impregnated with ink, said porous resin sheet including a heat-generating material which generates heat when exposed to electromagnetic waves, said heat generating material including heat-generating grains contained in said porous resin sheet; and a pattern formed on a surface of said porous resin sheet, said pattern including a non-print portion which blocks the permeation of said impregnated ink and a print portion which allows the permeation of said impregnated ink;

wherein said pattern is formed by exposing said porous resin sheet to said electromagnetic waves via a mask, said mask including a pattern portion which blocks said electromagnetic waves and a non-pattern portion which allows said electromagnetic waves to pass;

and wherein an exposed portion of said porous resin sheet is heated so that pores included in the exposed portion of said porous resin sheet are sealed and an unexposed portion of said porous resin sheet is not heated so that pores included in the unexposed portion of said porous resin sheet remain open.

2. The printing sheet according to claim 1, wherein said heat-generating grains are carbon grains.

3. The printing sheet according to claim 2, wherein the content of said carbon grain in said porous resin sheet is from 0.01 to 15 wt %.

4. The printing sheet according to claim 3, wherein said porous resin sheet is gray and, after said exposure to said electromagnetic waves, said porous resin sheet turns black.

5. The printing sheet according to claim 1, wherein said heat generating material includes a heat generating layer formed on said porous resin sheet, said heat generating layer being porous such that said heat generating layer allows the permeation of ink.

6. The printing sheet according to claim 5, wherein said heat generating layer is formed by laminating a film including heat-generating grains onto said porous resin sheet.

7. The printing sheet according to claim 5, wherein said heat generating layer is formed by brushing an agent including carbon grains onto said porous resin sheet.

8. The printing sheet according to claim 5, wherein said heat generating layer is formed by applying an agent including carbon grains and a solvent onto said porous resin sheet and dripping a solvent through said porous resin sheet such that the solvent dissolves portions of said agent at exits of pores of said porous resin sheet.

9. The printing sheet according to claim 1, wherein said porous resin sheet is made of polyolefin foam.

10. A blank sheet used to produce a printing sheet, wherein a pattern is to be formed on said blank sheet by exposing said blank sheet to electromagnetic waves via a mask, said blank sheet comprising:

a porous resin sheet which can be impregnated with ink; and a heat generating material provided to said porous resin sheet which generates heat when exposed to said electromagnetic waves, said heat generating material including carbon grains contained in said porous resin sheet;

wherein an exposed portion of said porous resin sheet is heated so that pores included in the exposed portion of said porous resin sheet are sealed and an unexposed portion of said porous resin sheet is not heated so that pores included in the unexposed portion of said porous resin sheet remain open.

11. The blank sheet according to claim 10, wherein said heat-generating material includes a heat generating layer formed on said porous resin sheet, said heat generating layer being porous such that said heat generating layer allows the permeation of ink.

12. A method for producing a printing sheet, using a porous resin sheet which can be impregnated with ink, said porous resin sheet including a heat-generating material which generates heat when exposed to electromagnetic waves, said heat generating material including grains contained in said porous resin sheet, said method comprising:

placing said porous resin sheet on a mask, said mask comprising a pattern portion which blocks said electromagnetic waves and a non-pattern portion which allows said electromagnetic waves to pass; and exposing a surface of said porous resin sheet to said electromagnetic waves via said mask.

13. The method according to claim 12, wherein said heat-generating material includes a heat-generating layer formed on said porous resin sheet, said heat generating layer being porous such that said heat generating layer allows the permeation of ink.

* * * * *